US006359379B1

(12) United States Patent
Lee et al.

(10) Patent No.: US 6,359,379 B1
(45) Date of Patent: Mar. 19, 2002

(54) CATHODE RAY TUBE HAVING FUNNEL WITH FLUTE SECTIONS

(75) Inventors: Bong-woo Lee; Do-nyun Kim, both of Kyungki-do (KR)

(73) Assignee: Samsug Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/435,278

(22) Filed: Nov. 5, 1999

(30) Foreign Application Priority Data

Jan. 8, 1999 (KR) ..... 99-288

(51) Int. Cl.[7] ..... H01J 31/00

(52) U.S. Cl. ..... 313/477 R; 220/2.1 R; 220/2.1 A

(58) Field of Search ..... 313/440, 106, 313/477 R, 441; 220/2.1 R, 2.1 A

(56) References Cited

U.S. PATENT DOCUMENTS 3,806,750 A * 4/1974 Tsuneta et al. ..... 313/64
5,155,411 A * 10/1992 Swank et al. ..... 313/477 R
5,801,481 A * 9/1998 Yokota ..... 313/440
6,087,767 A * 7/2000 Sano et al. ..... 313/440

* cited by examiner

*Primary Examiner*—Ashok Patel
(74) *Attorney, Agent, or Firm*—Christie, Parker & Hale, LLP

(57) ABSTRACT

Disclosed is a cathode ray tube comprised of a funnel with flute sections wherein the Beam Shadow Neck phenomenon can be prevented while at the same time ensuring adequate structural strength to prevent collapse due to an internal vacuum. These optimum flute sections are accomplished with the help of a computer simulation performance wherethrough electron beam orbits and funnel stress are interpreted.

4 Claims, 4 Drawing Sheets

CATHODE RAY TUBE HAVING FUNNEL WITH FLUTE SECTIONS

FIELD OF THE INVENTION

The present invention relates to a cathode ray tube, particularly to a cathode ray tube wherein an optimum flute portion is formed utilizing a computer simulation.

BACKGROUND OF THE INVENTION

A cathode ray tube is an electron tube wherein a picture is displayed on a screen through a method wherein electron beams emitted from an electron gun are deflected by horizontal and vertical magnetic fields of a deflection yoke. The deflection yoke is installed on the outside surface of a funnel of the cathode ray tube. The electron beams reach the fluorescent body of the screen as vertically and horizontally deflected beams.

In a conventional cathode ray tube, a cone portion of the funnel, whereon the deflection yoke is installed, has a circular cross-sectional shape. Further, a panel section that forms the screen and the region adjacent to the panel has a rectangular form.

However, the above cathode ray tube has a drawback in that a superior picture display is hard to achieve due to the beam shadow neck (BSN) phenomenon in which electron beams deflected by the deflection yoke and intended to reach the corner portions of the screen hit on an inside wall of the cone portion of the funnel.

Because the BSN phenomenon occurs principally in the cone portion of the funnel that is located opposite to a diagonal portion of the panel, grooves to prevent the BSN phenomenon are formed around the diagonal portion on which electron beams are hitting. The groove formed around the diagonal portions of the funnel is called a flute portion.

Recently, the above mentioned cathode ray tube has faced requirements that power consumption be spared for the sake of energy conservation and power efficiency, and that the release of magnetic fields should be strictly regulated to minimize the influence of electromagnetic waves on computer users for the sake of their health. Therefore, at issue now is how to lower power consumption of the deflection yoke which is the location of highest power loss.

For enhancement of product integrity and product quality, improvement of screen brightness and fine resolution picture should be achieved first. Electric power for the deflection yoke should be increased to achieve this purpose.

To improve screen brightness, the anode voltage charge for finally accelerating electron beams should be increased. As a result, increased electric power for deflection is needed to deflect the accelerated electron beams. Increased power for deflection is also needed when deflection frequency is increased to achieve a high resolution picture.

When wide angle deflection (e.g., 100°, 110°)is required for a thin television receiver because of the shorter length of the cathode ray tube, it can be realized by an increase of deflection power or an improvement of deflection sensitivity.

However, increased power for deflection leads to an increase in the strength of a generated magnetic field and an increase in power consumption. Therefore, a technique of enhancing deflection sensitivity and deflection efficiency is needed wherein increased brightness and a superior resolution picture are achieved and wide angle deflection performance is made possible while providing the same amount of power or less for deflection.

Accordingly, a technique for a cathode ray tube is provided wherein an outside circumferential shape of the funnel cone portion equipped with the deflection yoke is designed such that deflection of the electron beams becomes increasingly greater as they travel from a neck to a panel and can make various trajectories such as a circular or rectangular pattern. Accordingly, deflection sensitivity and deflection efficiency are enhanced by a minimized size of the cone portion equipped with the deflection yoke and by an installation of the deflection yoke closer to electron beams.

In the cathode ray tube of conventional structure wherein an outside circumferential shape of the cone portion is made in an ellipse or rectangular form, frequent BSN phenomena occur and deflection sensitivity decreases when the thickness of diagonal portions increases. However, thin diagonal portions can cause collapse of the funnel due to insufficient strength of the funnel against the inner pressure.

A cathode ray tube according to the present invention is provided to solve the above problems. A cathode ray tube is provided wherein BSN phenomenon can be prevented and enough structural strength against inner pressure is provided, because the cathode ray tube has an optimum flute portion designed with the help of a computer simulation wherethrough electron beams orbits and funnel stress are interpreted.

SUMMARY OF THE INVENTION

A cathode ray tube according to the present invention comprises a panel that forms a screen on an inside face thereof, a funnel connected to the panel and having the deflection yoke on some outside circumference thereof, and a neck connected to the funnel. Inside the neck, an electron gun is installed by insertion thereinto.

A flute portion is designed such that a cone shaped outside contour of the funnel equipped with the deflection yoke changes from a circular shape to a non-circular shape as it travels from the neck thereof to the panel thereof. The cone portion of the funnel has grooves that are formed inside the edge portion of a diagonal line along a longitudinal axis direction of the cathode ray tube.

The flute portion is also designed such that a line indicating a changed flute angle along the cone portion of the funnel has at least one maximum angle between the neck seal face and the standard deflection position when a flute angle is defined as an angle formed between the diagonal axis line and a line formed on a vertical plane by connecting an edge point of the flute groove and the origin that is on the longitudinal axis line of the tube.

The flute portion is further designed such that the changed flute angle along the cone portion of the funnel flatly decreases from the standard deflection position to the inflection point.

BRIEF DESCRIPTION OF THE DRAWINGS

These and other features, aspects, and advantages of the present invention will become better understood when considered in conjunction with the following description, appended claims, and accompanying drawings, wherein:

DETAILED DESCRIPTION OF THE INVENTION

Figure 1:
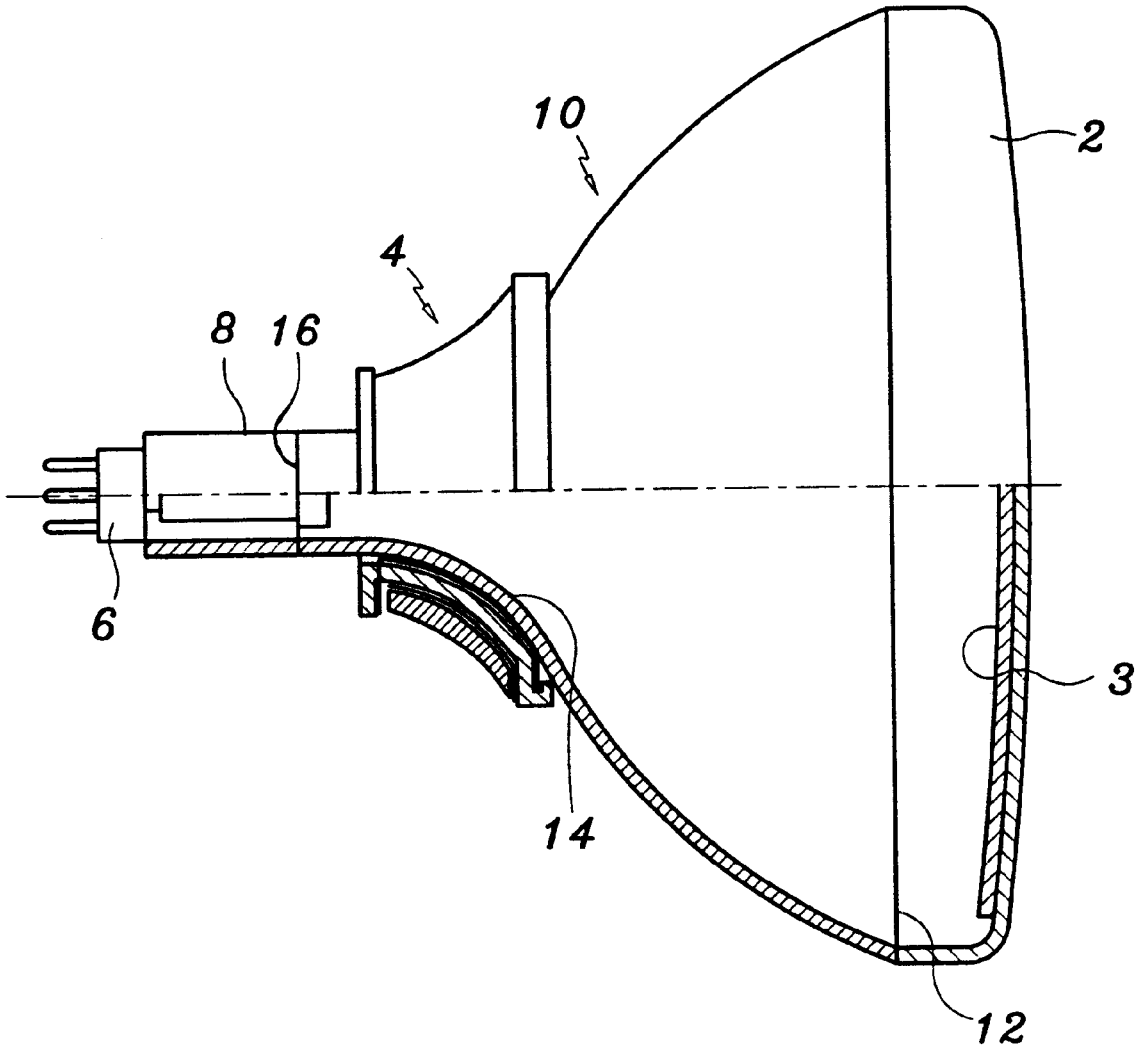
FIG. 1 is a cutaway cross sectional view showing an embodiment of a cathode ray tube according to the present invention.
Figure 2:
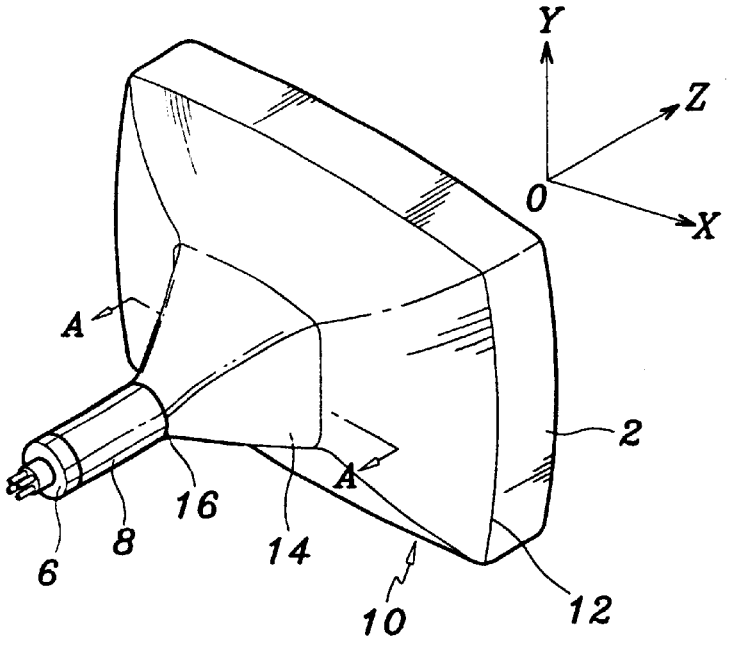
FIG. 2 is a rear perspective view showing a vacuum vessel according to an embodiment of said cathode ray tube of the present invention.
Figure 3:
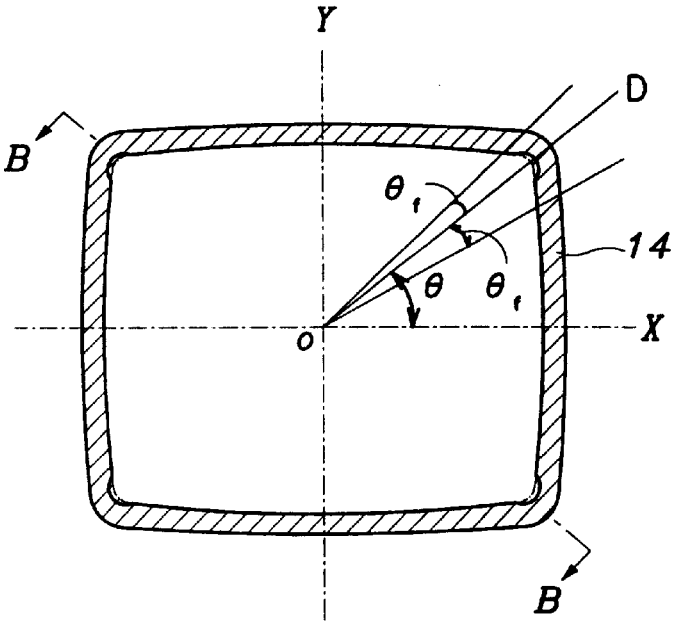
FIG. 3 is a cross sectional view showing the A—A portion of FIG. 2.

An embodiment of a CRT according to the present invention is shown in FIGS. 1 to 3. The CRT comprises a panel 2 having a phosphor screen 3 on the inner surface, a funnel 10 connected to the panel 2 along line 12, and a neck 8 integrally connected to the funnel along line 16. A deflection yoke 4 is mounted on a cone 14. The cone is a portion of the funnel closer to the neck. The neck encloses an electron gun assembly 6. The contour of a cross section of the cone, on a plane parallel to the screen, changes from circular to non-circular as the cross section is made from the neck seal closer to the panel.

In order to better define the invention, a Z axis is defined to be the tubular axis normal to the panel surface at the center of the panel. Further, an X axis and a Y axis are a horizontal axis and a vertical axis respectively, each intersecting the Z axis, as shown in FIG. 3. A D axis is an axis including a point on the Z axis on an XY plane intersecting that point and a particular point on the contour of a cross section of the cone such that the distance between the two points becomes the maximum. θ is the diagonal angle between the D axis and the X axis and can be expressed as $\tan^{-1}$ N/M, wherein N/M is the height-to-width ratio, or the aspect ratio, as known in the art.

The present invention provides a flute portion 20 inside the diagonal corners of the cone, wherein a groove is formed along the flute portion. A flute angle $\theta_f$ is defined as an angle between the D axis and a line which passes the Z axis and either end of the groove on the XY plane. In other words, given the contour of a cross-section of the cone perpendicularly crossing the Z axis, one can draw a first line passing the Z axis and the farthest point on the contour and a second line likewise passing the Z axis and a point on the contour at which point the section representing the groove begins. The flute angle $\theta_f$ on the XY plane varies as the cross-section is taken from the neck seal to the standard deflection position RL in such a way that it has at least one peak. In other words, the flute angle on an XY plane crossing one point on the Z axis is differently made from the flute angle on an XY plane crossing a different point on the Z axis since the depth and width of the groove are not uniform but rather increase to a certain point before they decrease. The flute angle $\theta_f$ at RL reference line is made to be one half of the maximum flute angle.

A computer simulation showed that the flute angles meeting the following equation are preferable because a CRT having this range of flute angles does not suffer from the aforementioned BSN phenomenon because electron beams deflected in a diagonal direction were shown to have a deviation from their intended trajectories by −3.7 to 3.7 degrees.

$$0 \text{ degrees} < \theta_f < 3.7 \text{ degrees} \qquad \text{Equation 1}$$

A CRT having a flute portion along its diagonal direction having a flute angle in the above range has sufficient structural strength to withstand the external atmospheric pressure. The flute angle is gradually increased from the neck seal toward the panel, reaching a maximum at a predetermined position before it is gradually decreased up to the boundary between the cone and the rest of the funnel. Therefore, a flute line 28 tracing the edge of the groove along the diagonal direction of the cone will be a curved one as shown in FIG. 5.

Figure 4:
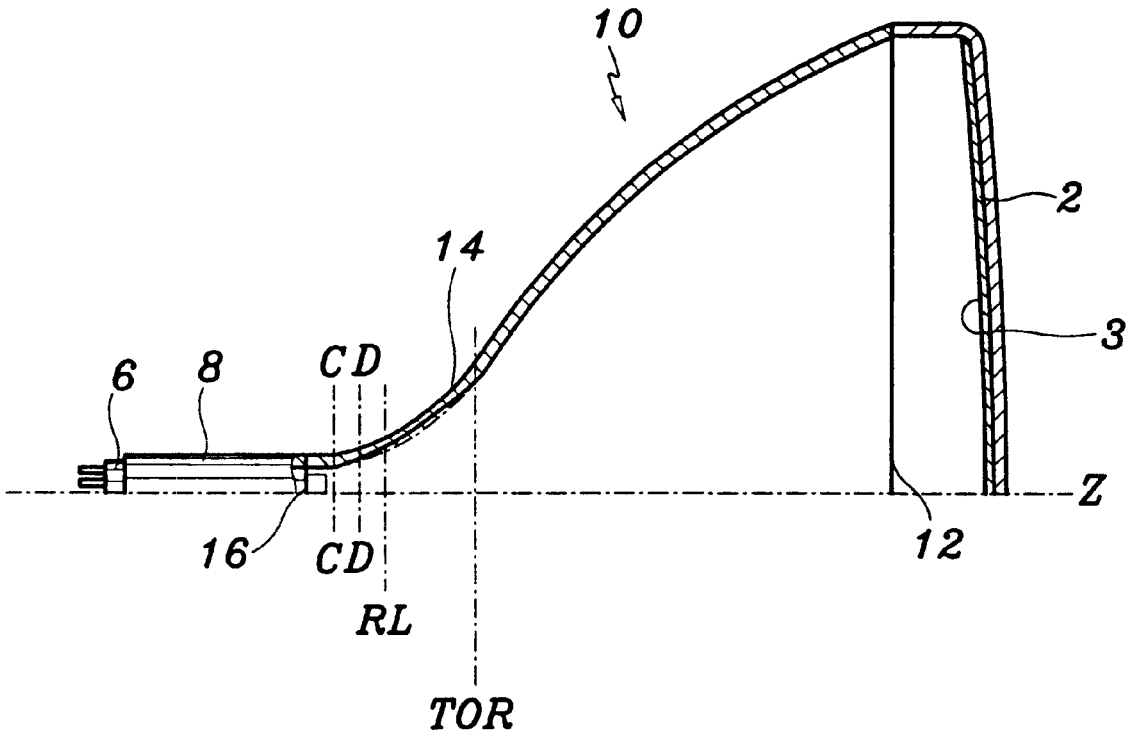
FIG. 4 is a cross sectional view showing the B—B portion of FIG. 3.
Figure 5:
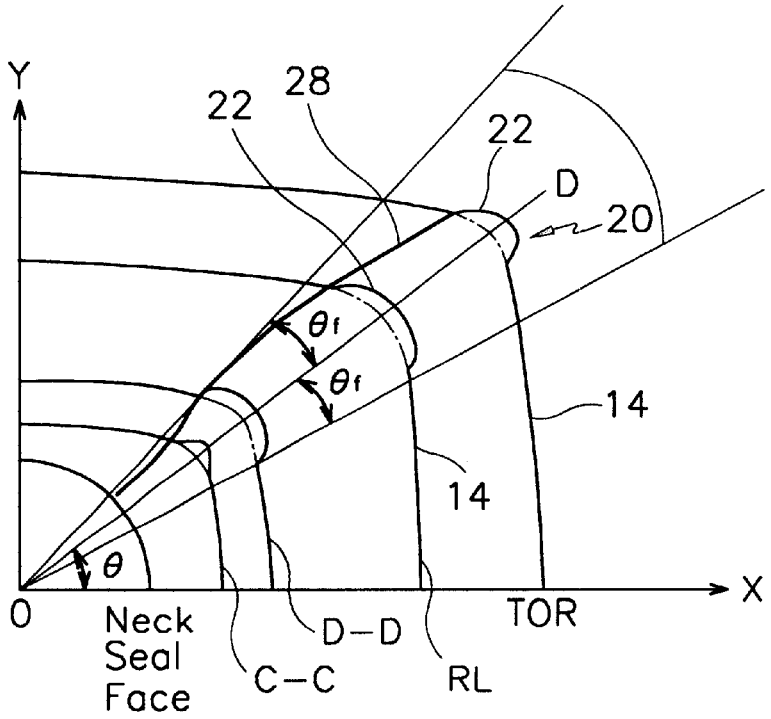
FIG. 5 is a graph indicating a flute angle at the cross section of the cone portion of the funnel taken along various points along the axis of the funnel.
Figure 6:
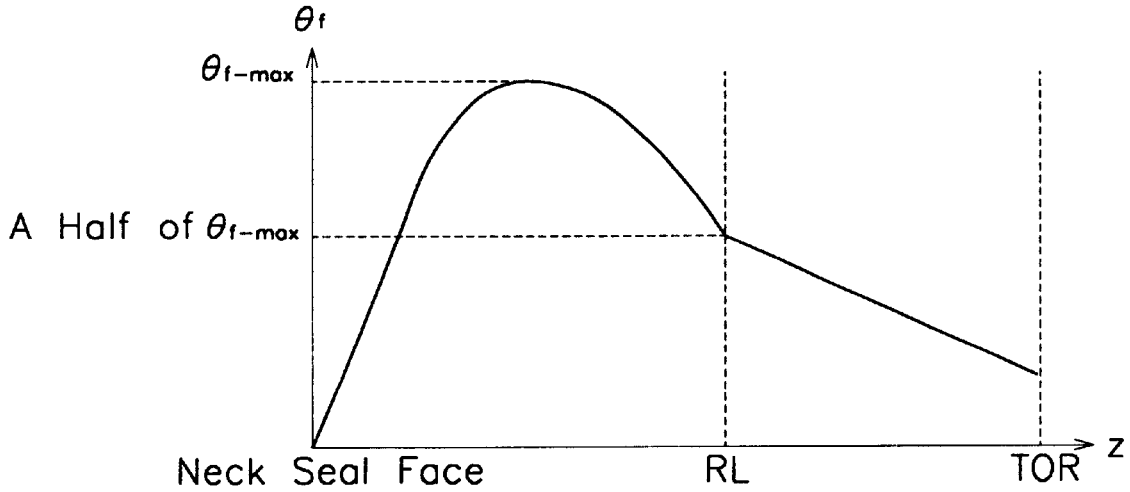
FIG. 6 is a graph showing a curved line indicating a change in a flute angle.

FIG. 5 also shows a first quadrant of a cross section of the cone taken at different points along the Z axis. The cross sections, which are shown in FIG. 4, are at the neck seal, C—C, D—D, a standard deflection position RL and the inflection point TOR. The inflection point is, as known in the art, the point at which, when seen from outside, the concave inner surface of the cone ends and the convex inner surface of the remaining funnel begins. The graph of FIG. 6 illustrates the changing flute angle with respect to the Z axis. As mentioned previously the flute angle has at least one peak in the region between the neck seal and the standard deflection position RL although an embodiment having a single peak has been illustrated. Moreover, the flute angle is decreased linearly from the RL to TOR position.

While the present invention has been described in detail with reference to the preferred embodiments, those skilled in the art will appreciate that various modifications and substitutions can be made thereto without departing from the spirit and scope of the present invention as set forth in the appended claims.

This application is based on application Ser. No. 99-288 filed in the Korean Industrial Property Office on Jan. 8, 1999, the content of which is incorporated herein by reference.

What is claimed is:

1. A cathode ray tube comprising:

a face panel having a phosphor screen formed on its inner surface;

a funnel connected to the face panel;

a neck integrally connected to the funnel at a neck seal position; and a deflection yoke mounted on a cone portion of the funnel;

wherein a cross section of the cone portion changes from circular to rectangular from the neck seal toward the panel and a groove is formed along each diagonal of the cone portion; and wherein a flute angle, defined as an angle between a first axis and a second axis, which are normal to a tube axis and connects the farthest point on the contour of a cross section of the cone portion and a point on the contour at which the section representing one of the grooves begin, varies from one cross-section to another and has at least one peak between the neck seal position and a standard deflection position of the cone portion, and decreases between the standard deflection position and an inflection point position of the cone portion.

2. A cathode ray tube according to claim 1, wherein the magnitude of a varying flute angle of the cone portion of the funnel satisfies the following equation:

$$0 < \theta_f \leqq 3.7 \qquad \text{Equation 1}$$

where the diagonal angle (θ), when a height to width ratio of the phosphor screen of the cathode ray tube is M:N, is expressed as $\tan^{-1}$ N/M, and a flute angle ($\theta_f$) is defined as an angle between a diagonal axis line D and a line formed on a vertical plane by connecting an edge point of a flute groove and the origin (O) of a horizontal axis line.

3. A cathode ray tube comprising:

a face panel having an inner surface with a phosphor screen;

a funnel coupled to the face panel;

a neck coupled to the funnel; and a deflection yoke disposed on a cone portion of the funnel;

wherein said cone portion comprises a cross section which changes from circular at the neck to rectangular toward the panel, said cone having an axial groove formed along a path intersecting a radial diagonal axis; and wherein a flute angle, comprising an angle between the radial diagonal axis and a radial axis extending through an edge of the groove, varies along the axial direction and comprises at least one peak between the neck and a standard deflection position of the cone portion, and decreases between the standard deflection position and an inflection point position of the cone portion.

4. A cathode ray tube according to claim 3, wherein the magnitude of the varying flute angle is in the range of 0 to 3.7°.

* * * * *